United States Patent [19]

Tanner

[11] Patent Number: 4,661,049

[45] Date of Patent: Apr. 28, 1987

[54] METERING PUMP

[76] Inventor: Dale Tanner, 201 Evergreen Ave., Apt. 6-2A, Vestal, N.Y. 13850

[21] Appl. No.: 768,850

[22] Filed: Aug. 23, 1985

[51] Int. Cl.[4] ..... F04B 7/00

[52] U.S. Cl. ..... 417/418; 417/517; 417/519; 417/532

[58] Field of Search ..... 417/517-519, 417/532, 418

[56] References Cited

U.S. PATENT DOCUMENTS

| | | | |
|---|---|---|---|
| 15,134 | 6/1856 | King | 417/532 |
| 170,008 | 11/1875 | McCormack et al. | 417/532 X |
| 717,977 | 1/1903 | Donoughe | 417/517 |
| 726,429 | 4/1903 | Hicks | 417/517 |
| 2,349,150 | 5/1944 | Falasconi | 417/519 X |
| 3,694,112 | 9/1972 | Freedman | 417/517 |

*Primary Examiner*—Carlton R. Croyle
*Assistant Examiner*—Theodore Olds
*Attorney, Agent, or Firm*—Robert K. Youtie

[57] ABSTRACT

A metering pump including adjacent valve and pump chambers, the valve chamber having inlet and outlet connections and a valve plug angularly shiftable in the valve chamber to communicate said connections with opposite sides of the plug upon angular shifting of the plug, and a reciprocatory piston in the pump chamber, there being fluid communication between opposite ends of the pump chamber and the valve chamber on opposite sides of the valve plug, so that piston reciprocation in both directions moves fluid in the inlet connection and out the outlet connection upon shifting of the valve plug.

5 Claims, 8 Drawing Figures

FIG. 7
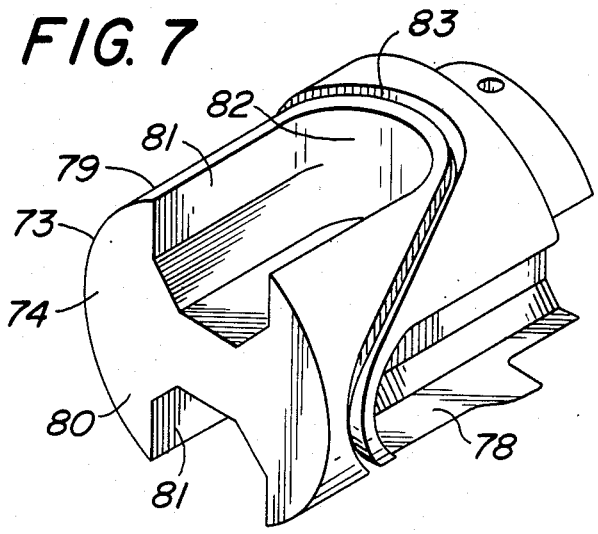
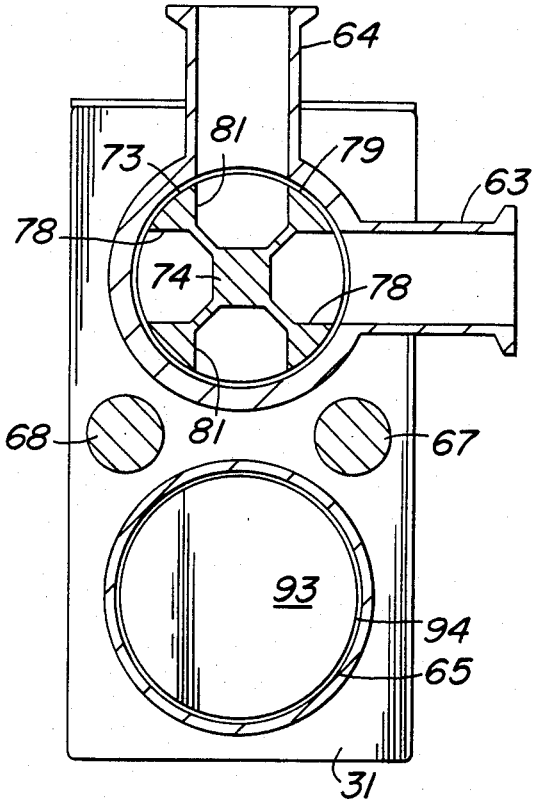
FIG. 8

METERING PUMP

BACKGROUND OF THE INVENTION

This invention is concerned with fluid handling apparatus of the general type disclosed in my prior U.S. Pat. Nos. 4,518,102 and 3,653,545.

While the metering devices of said prior patents have been highly satisfactory in use, it has been found desirable to even further simplify disassembly for cleaning, afford unobstructed passage to larger particulates and suspended solids, enhance the ease of pumping stroke adjustment, and afford greater versatility permitting selection of various driving elements for use under different conditions.

SUMMARY OF THE INVENTION

Accordingly, it is an important object of the present invention to provide a metering pump of the type described wherein all parts requiring cleaning may be quickly and easily removed for cleaning and replacement; wherein passageways are of increased transverse dimension to pass relatively large particulates and suspended solids; wherein stroke adjustment is accomplished with utmost ease and great speed; and where drive power may be entirely electric, to avoid the need for a pneumatic power source.

It is a further object of the present invention to provide a metering pump having the advantageous characteristics mentioned in the preceding paragraph, wherein metering is achieved simultaneously with double acting pumping to maximize production and minimize cost.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 7 is a perspective view showing the valve plug of the present invention apart from the remainder of the pump.

FIG. 8 is a transverse sectional elevational view taken generally along the line 8—8 of FIG. 5.

DESCRIPTION OF THE PREFERRED EMBODIMENT

Figure 1:
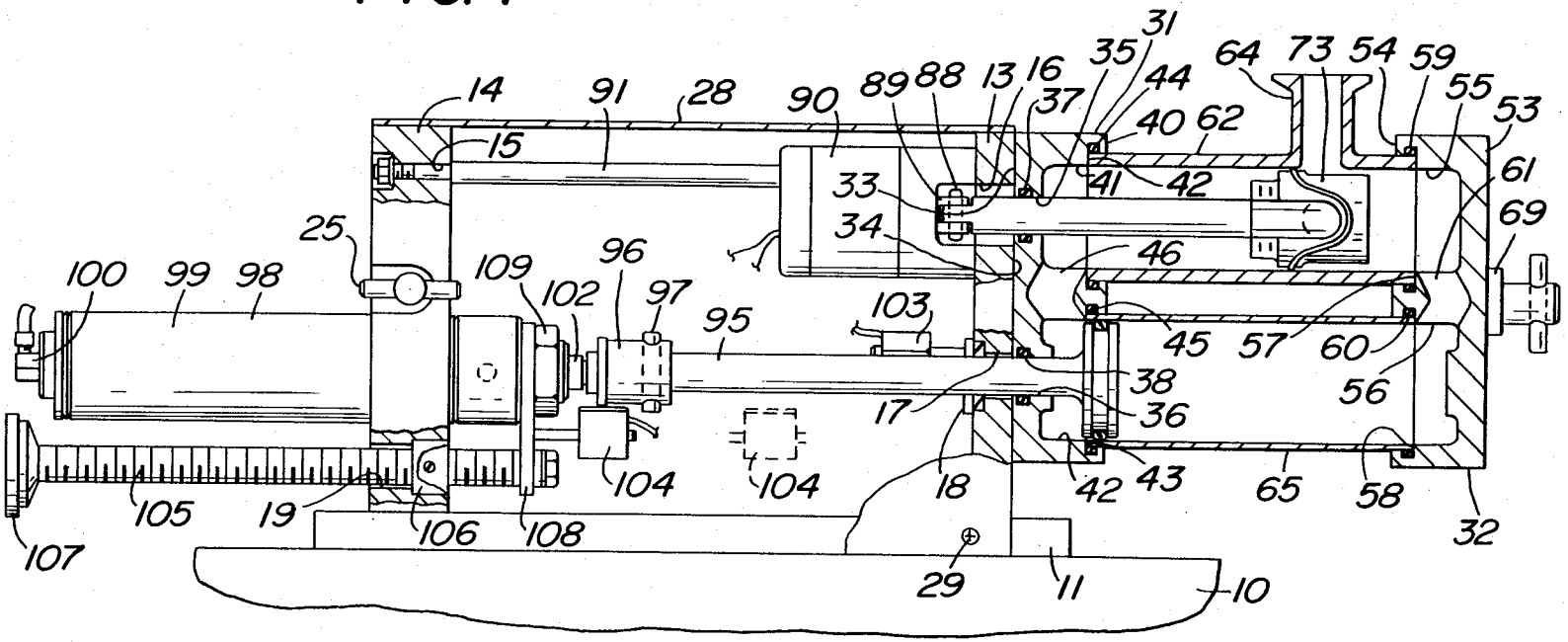
FIG. 1 is a longitudinal or side view showing a metering pump of the present invention, partly in section to illustrate interior construction.
Figure 2:
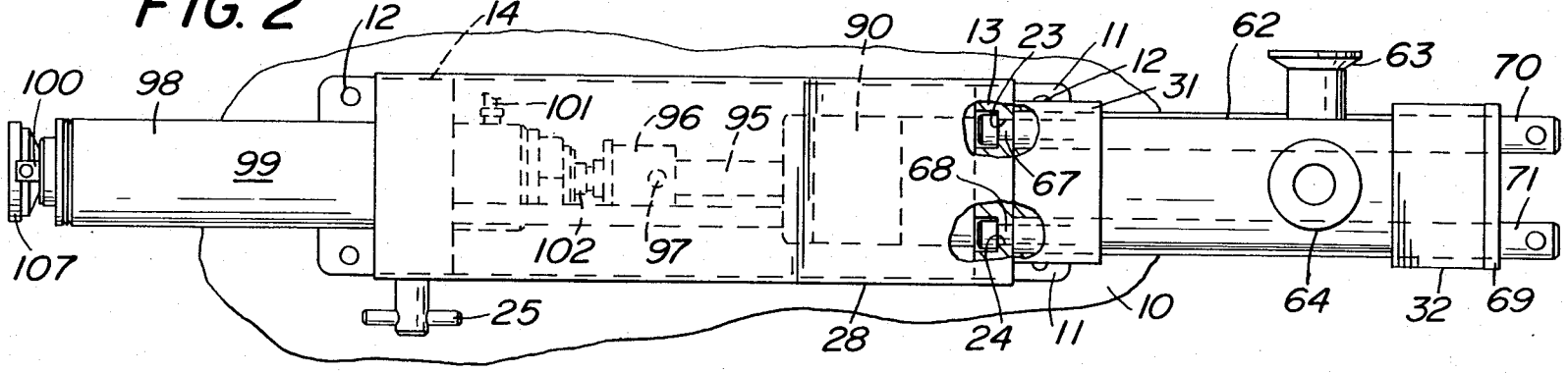
FIG. 2 is a top plan view showing the pump of FIG. 1
Figure 4:
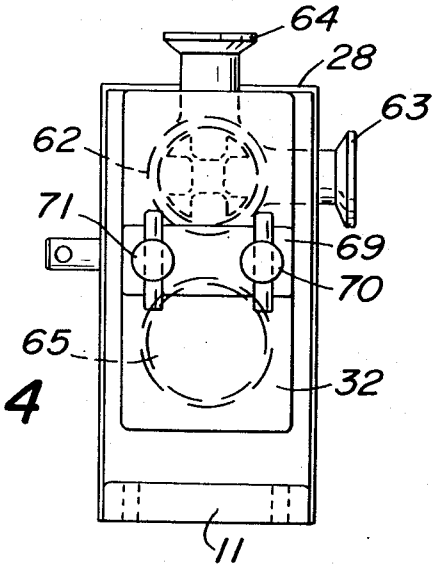
FIG. 4 is an end view of the pump as taken from the right hand end of FIG. 2.
Figure 3:
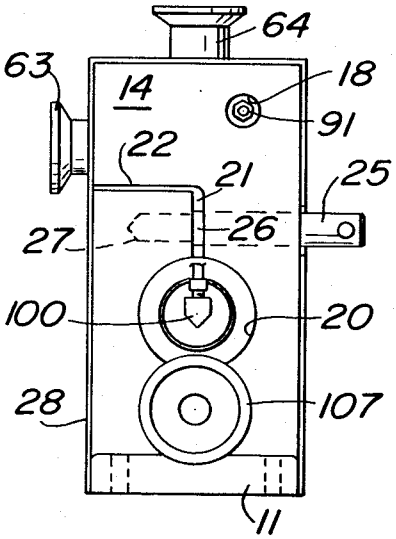
FIG. 3 is an end view of the pump as taken from the left hand end of FIG. 2.

Referring now more particularly to the drawings, and specifically to FIGS. 1 and 2 thereof, a supporting surface or floor is generally designated 10, and a generally horizontal base 11 is suitably fixed to the floor, as by fasteners 12.

The base 11 is generally elongate, and upstanding therefrom adjacent to opposite ends thereof may be a pair of spaced standards 13 and 14. The standard 13 may be considered as the forward or head end standard, while the standard 14 may be considered as rearward. As best seen in FIG. 1, the forward standard 13 includes upper and lower through openings 16 and 17, the latter of which may be provided with a bumper or cushion 18. In addition, the forward standard 13 may be provided at an intermediate elevation with a pair of laterally spaced contersunk through bores 23 and 24.

The rear upright or standard 14 may be provided in an upper region with a countersunk through bore or opening 15, and in a lower region with a through bore or opening 19. Spaced over the lower bore 19 in the standard 14 is a relatively large through bore 20; and, an angulate slot 21 extends from the bore 20 upwardly and thence laterally, as at 22, outwardly through one side of the standard 14. The depth of slot 21, 22 is such as to open through both faces of the standard 14. This slot structure, and the inherent resilience of the standard 14 enables parts of the standard on opposite sides of the slot to be moved toward and away from each other, whereby the effective internal diameter of the bore 20 is decreased and increased. Toward this end a threaded tie member or bolt 25 may extend laterally inwardly through one side of the standard 14, across the slot portion 21, as at 26, and threaded into the opposite sides of the slot portion, as at 27. By this bolt, the opposite side portions of the standard 14 may be moved toward each other and released away from each other by turning of the bolt 25.

A cover or hood 28 may extend over and between the standards 13 and 14 to enclose the space therebetween. The cover or hood 28 may be removably secured in position, as by fasteners 29 extending into the base 11. As will appear presently, the base 11 and standards 13 and 14 define a mounting structure for mounting the several components of the metering pump.

Additional mounting structure includes a pair of facing spaced end members 31 and 32 forward of the front standard 13. The end members 31 and 32 may be generally identical, of elongate, generally rectangular configuration and having one face generally flat. More specifically, the end member 31 has one surface 33 generally flat and in facing engagement with the front surface 34 of the forward standard 13. The end member 31 includes a pair of upper and lower through holes 35 and 36 respectively opening into upper and lower through holes 16 and 17 of the front standard 13. The holes 35 and 36 of end member 31 may be provided with annular seals 37 and 38. The forward or outer surface 40 of the end member 31 may also be generally flat and is provided with upper and lower, generally circular forwardly opening recesses 41 and 42, respectively generally concentric with through openings 35 and 36. Surrounding the recess 41 may be a forwardly facing annular shoulder 42, and similarly surrounding the lower recess 42 may be an annular, forwardly facing shoulder 43. Annular seals or O-rings 44 and 45 may respectively surround shoulders 42 and 43. Opening between the recesses 41 and 42, spaced between the rearward and forward walls 33 and 40 of the end member 31 is a port or passageway 46.

The forward end member 32 may be essentially similar to the rearward end member 31, but in facing relation with respect thereto. The forward surface 53 of end member 32 may be generally flat, but without openings corresponding to openings 35 and 36 of the end member 31. The inwardly facing surface 54 of end member 32 may be generally flat, substantially parallel to surface 53, and provided with upper and lower, generally circular recesses 55 and 56 in opposed, aligned facing relation with recesses 41 and 42, respectively. Surrounding the upper recess 55 is a rearwardly facing annular shoulder 57, and a rearwardly facing annular shoulder 58 surrounds the lower recess 56. An annular seal or O-ring 59 surrounds the shoulder 57, extending partially thereover, and similarly, an annular seal or O-ring 60 surrounds the shoulder 58 and extends partially over the latter. An internal port or passageway 61 communicates in the end member 32 between recesses 55 and 56.

An open ended cylinder or valve chamber extends between the end members 31 and 32 having its respective rearward and forward ends in aligned abutting engagement with respective shoulders 42 and 57 of recesses 41 and 55. Thus, the end members 31 and 32 serve to close rearward and forward ends of valve chamber or cylinder 62, recesses 41 and 55 opening into the rearward and forward ends of the valve chamber and seals 44 and 59 being in sealing engagement with rearward and forward ends of the valve chamber.

Intermediate the ends of the cylinder or valve chamber 62, there is provided a radial nipple or fluid connection 63 on one side of the valve chamber. If desired, a pair of such connections, hereinafter called inlet connections, may be provide on opposite sides of the valve chamber. In addition, an outlet fluid connection or nipple 64 may be provided intermediate the ends of valve chamber 62, extending radially therefrom generally coplanar with the connection 63, as best seen in FIG. 1. Suitable conduits may be connected to the inlet and outlet connections 63 and 64, as desired.

An additional, open ended cylinder 65 is located below and generally parallel to the cylindrical valve chamber 62, extending between the end members 31 and 32 and opening into end member recesses 42 and 56. The cylinder 65 has its opposite ends closed by end members 31 and 32 to define a pump chamber. Specifically, the rearward end of pump chamber cylinder 65 is in aligned engagement with annular shoulder 43 and the forward end of the cylinder is in aligned engagement with the annular shoulder 58, the rearward and forward ends of the pump chamber cylinder being effectively sealed by seals 45 and 60.

The assembly of end members 31 and 32 and interposed valve and pump chambers 62 and 65 are effectively held together by a pair of elongate tie members 67 and 68 extending between the end members and into the standard 13. The tie members 67 and 68 may extend through respective openings 23 and 24 in standard 13, having head ends received in the countersinks of the openings for retaining the tie members in the standard. The other ends of the tie members may extend through and forwardly beyond the forward end member 53, there being provided with a bearing plate 69 and respective removable fasteners or nuts 70 and 71 for detachably clamping the assembly together.

Rotatably received in the valve chamber 62 is a valve plug 73. The valve plug 73 is best seen in FIGS. 5–8, being a generally cylindrical, substantially solid body 74. The body 74 is provided at one end with a relatively short inwardly extending axial bore 75, and in crossing relation therewith a transverse through hole 76. The blind bore 75 extends inwardly through the end surface 77 of the body 74, and additionally a pair of longitudinal grooves 78 are formed in the external surface 79 extending inwardly from the end surface 77 in diametrically opposed relation with each other. The external grooves 78 open oppositely radially outwardly from the valve plug 73, extending longitudinally inwardly through end surface 77 and terminating short of the opposite plug end surface 80.

An additional pair of radially outwardly opening grooves 81 are formed in the body 74 extending longitudinally inwardly through the valve plug end surface 80 and opening radially outwardly through the valve plug cylindrical surface 79. The grooves 81 are angularly spaced approximately 90° from and between the grooves 78, as best seen in FIG. 8, and extend inwardly from the valve plug end surface 80 while terminating short of the opposite valve plug end surface 77. It may be desirable that the grooves 81 terminate at their inner ends 82 longitudinally short of the bores 75 and 76.

Thus, the several grooves 78 and 81 are equally angularly spaced from each other approximately 90°, and adjacent grooves are longitudinally offset from each other, as best seen in FIG. 7. By this configuration the external cylindrical surface 79 of the valve plug 73 is circumferentially continuous about the valve plug in an undulating configuration about the closed ends of the grooves 78 and 81. Formed in the external cylindrical surface 79 may be a sinusoidal groove 83 extending continuously about the circumference of the valve plug in the cylindrical surface 79 and adapted to receive an endless sealing member or gasket 84.

Figure 5:
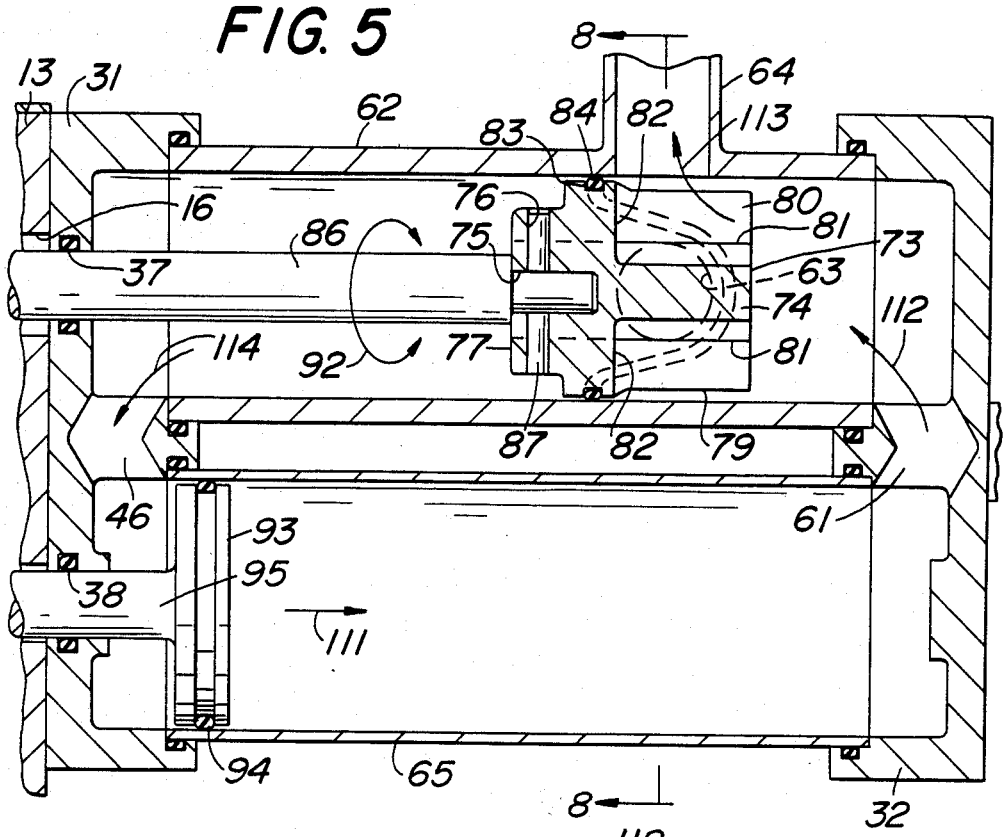
FIG. 5 is an enlarged partial sectional view similar to FIG. 1, but illustrating one condition of operation.
Figure 6:
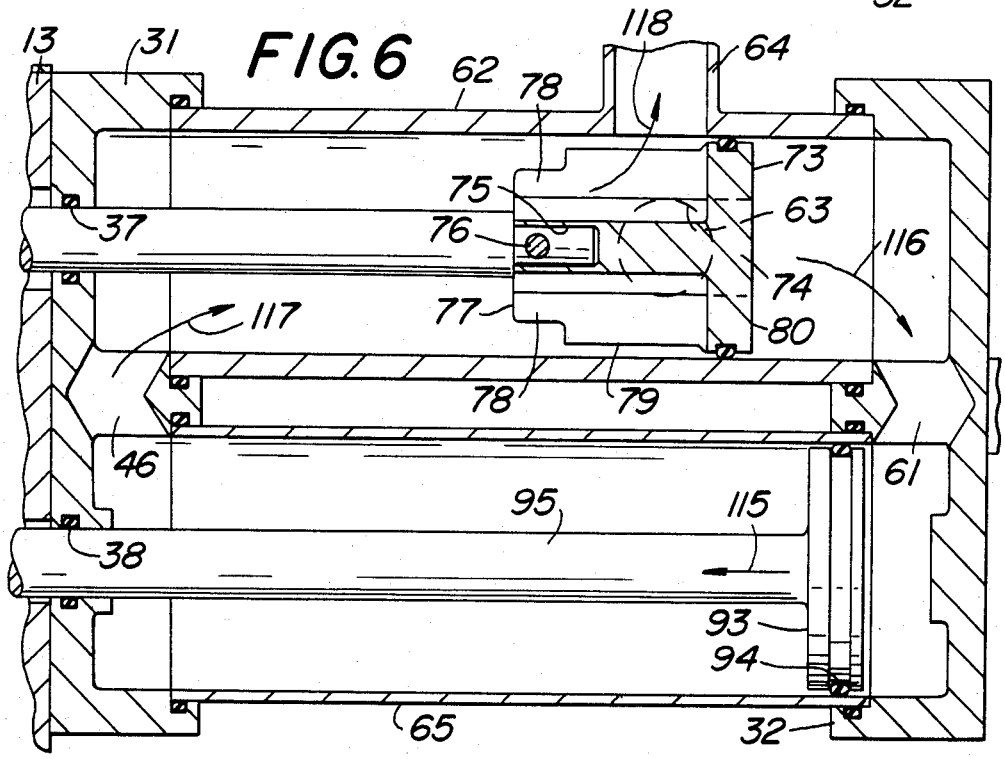
FIG. 6 is a view similar to FIG. 5 illustrating the other condition of operation.

The valve plug 73 is shown in assembled relation in the valve chamber 62 in FIGS. 5 and 6, and as described the valve plug grooves or passageways 78 and 81 overlap in the longitudinally midregion of the valve plug, which midregion is in alignment with the generally coplanar inlet and oulet connections 63 and 64. Thus, in the condition shown in FIG. 5 the grooves 81, or one of them communicates between the right hand or forward end of valve chamber 62 and the outlet connection, while the grooves 78, or one of them communicates between the left or rearward end of the valve chamber and the inlet connection 63. Communication between the inlet and outlet connections, and between opposite ends of the valve chamber is precluded by the sinusoidal gasket 84.

A rotary shank or shaft 86 extends through the hole 16 in standard 13 and into blind bore 75 of valve plug 73, being bored to receive a cross pin 87 in transverse hole 76. The rotary shaft 86 extends in sealed relation through the sealing element 37 and through and rearward beyond the standard 13 for connection, as by a pin 88 to the rotor 89 of a rotary actuator 90. The actuator 90 may be suitably mounted as by one or more bolts 91 extending from the actuator and anchored in the bore 15 of standard 14. The rotary actuator may be any suitable type, say an electric motor shiftable 90°, either in the same direction or in opposite directions, or could be operated by hydraulic or pneumatic fluid, or otherwise. The directional arrow 92, see FIG. 5, indicates rotation of the shaft 86 in opposite directions, but this is not necessary as stepping 90° in the same direction would perform satisfactorily.

A piston or plunger 93 is reciprocable in pump chamber 65, the piston being provided with a suitable seal or piston ring 94. A piston rod 95 may extend from the piston 93 slidably and in sealed relation through seal 38 and hole 17 rearward beyond the standard 13. See FIG. 1. There the rod 95 is detachably connected to a coupling 96, as by a removable retaining pin 97. The coupling 96 is shiftable by a linear actuator 98 mounted in the standard 14. The linear actuator 98 may be pneumatic, as illustrated, or of other suitable construction, such as a gear motor drive and ball screw, which could be self reversing to enable the motor to operate continuously in one direction. Other suitable linear actuators may be employed, if desired.

The illustrated linear actuator 98 may include a cylinder 99 clamped at a selected location in the bore 20 of standard 14. Suitable fluid connection means 100 and 101 may be provided adjacent to opposite ends of the cylinder 99 for effecting movement of the piston rod 102 back and forth, together with its coupler element 96. Limit switches or sensors 103 and 104 are located along the path of movement of rod 95, the former being suitably fixed, and the latter adjustable, as will appear presently. That is, an adjustment device or screw 105 extends spacedly through bore 19 of standard 14, and threadedly through a nut 106 fixed in the bore 19. An operating handle 107 may be carried by the screw 105 on its rearward end, and a transverse connector 108 may be rotatably connected to the screw 105 and fixedly connected, as by a nut 109 to the cylinder 99. Thus, with the clamping screw 25 open or loose to permit sliding movement of the cylinder 99 in bore 20, the adjustment screw 105 may be rotated in threaded engagement with fixed nut 106 to cause longitudinal translation of the adjustment screw. The connector 108 moves longitudinally with the adjustment screw 105, but not rotationally, and is fixed relative to the actuator 98 to effect longitudinal positioning of the latter. This adjustably positions the sensor or limit switch 104, say to an illustrated phantom position. The bolt 25 may then be locked to clamp the linear actuator in position to achieve the desired stroke of piston 93 in pump chamber 65.

From FIGS. 5 and 6 it will be apparent that opposite sides of the valve plug 73 communicate with opposite sides of the piston 93 through passageways 46 and 61. In the condition shown in FIG. 5 with the piston 93 moving rightward in the direction of arrow 111, fluid is caused to move out of pump cylinder 65 through passageway 61 in the direction of arrow 112 into valve chamber 62, and thence outwardly from the valve chamber in the direction of arrow 113, exiting through outlet connection 64. Simultaneously fluid is caused to be drawn into the left side of pump chamber 65 through passageway 46 in the direction of arrow 114, entering through inlet connection 63 into the left region of valve chamber 62.

When the piston 93 has reached its rightmost position, as shown in FIG. 6, the valve plug 73 is rotated 90° and the pump piston reverses direction to move leftward in the direction of arrow 115. It is shown in FIG. 6, by arrow 116 that fluid is drawn inwardly through inlet conduit 163 onto the right side of valve plug 73 and through passageway 61 into the right side of pump chamber 65. Simultaneously, fluid in pump chamber 65 on the left side of piston 93 moves in the direction of arrow 46 onto the left side of valve plug 73 and exits in the direction of arrow 118 through outlet connection 64. This double action pumps continuously in the same direction upon piston movement in opposite directions. If desired to assure equal volumes being pumped on movement of piston 93 in opposite directions, there may be provided an extension of rod 95 rightward from piston 93 in sealed reciprocating relation through and out of the end member 32.

It will now be appreciated that quick and easy disassembly and reassembly, as for cleaning, may be very simply achieved by removing fasteners 70 and 71, and pins 88 and 97. The valve chamber 62 and pump chamber 65, together with the end members 31 and 32 and the valve plug 73 and piston 93 and their rods 86 and 95 may be withdrawn and disassembled for sanitary procedures.

The valve plug 73, by its internally solid configuration may be provided with relatively deep grooves 78 and 71 to pass large particulates and suspended solids.

Stroke adjustment, as by loosening of fastener 25 and selective positioning of cylinder 99 by actuator 105 is quick, infinitely adjustable, and accurately repeatable.

From the foregoing it is seen that the present invention provides a metering pump which is extremely simple in construction maintenance and operation, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. a metering pump comprising a mounting structure, a cylindrical valve chamber mounted by and extending from said mounting structure, a single pair of angularly spaced inlet and outlet connections opening into said cylindrical valve chamber intermediate the ends thereof, a valve plug angularly shiftable in said valve chamber adjacent to said inlet and outlet connections, a cylindrical pump chamber mounted by and extending from said mounting structure generally parallel to said cylindrical valve chamber and having spaced locations at its opposite ends in respective fluid communication with opposite ends of said valve chamber on opposite sides of said valve plug, said plug having angularly spaced passageways extending longitudinally of and opening through opposite ends of said plug, said plug passageways each communicating one of said valve chamber connections with a respective one of said spaced end locations of said pump chamber and upon angular plug shifting communicating said one valve chamber connections with the other of said spaced end locations, and a piston in said pump chamber reciprocating between spaced end locations for alternately moving fluid in said inlet connection and out said outlet connection, said mounting structure comprising a pair of end members, said cylindrical valve and pump chambers extending between said end members, said end members being in clamping engagement with the ends of said cylindrical chambers and having passageways defining communication between adjacent chamber ends, and releasable tie members extending between said end members and retaining said clamping engagement.

2. A metering pump according to claim 1, said mounting structure comprising a base, a standard upstanding from said base, said end members comprising an inner end member proximate to said standard and an outer end member remote from said standard, said tie members extending through said end members and standard to retain said clamping engagement and mount said end members and cylindrical chambers to said standard for ease of assembly and disassembly.

3. A metering pump according to claim 2, in combination with a shaft coaxial with said valve chamber extending from said valve plug rotatably through said inner end member and standard for detachable connection to a rotary actuator, and a rod coaxial with said pump chamber extending from said piston longitudinally shiftably through said inner end member and standard for detachable connection to a linear actuator, to facilitate disassembly of said end members, chambers, valve plug and piston by detachment of said rod and shaft from their actuators.

4. A metering pump according to claim 1, said valve plug comprising a body extending across said valve chamber having spaced longitudinally overlapping external grooves defining said passageways, and a rotary shaft extending centrally into said valve chamber and nonrotatably connected to said valve plug to rotate the latter, said valve plug being internally solid and fixed at one end of said shaft, so that said grooves may be relatively deep for maximum cross section of said passageways.

5. A metering pump according to claim 4, in cobmiantion with gasket means externally on said body in sealing relation with said valve chamber and on opposite sides of said passageways to seal the latter from each other, said gasket means extending generally sinusoidally about said valve plug to effect said sealing between overlapping grooves.

* * * * *